US009890502B2

(12) United States Patent
Shannon et al.

(10) Patent No.: US 9,890,502 B2
(45) Date of Patent: Feb. 13, 2018

(54) TISSUE PRODUCTS COMPRISING HIGH CARBOHYDRATE CONTENT FILLERS

(71) Applicant: Kimberly-Clark Worldwide, Inc., Neenah, WI (US)

(72) Inventors: Thomas Gerard Shannon, Neenah, WI (US); Bo Shi, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 107 days.

(21) Appl. No.: 14/903,313

(22) PCT Filed: Apr. 30, 2015

(86) PCT No.: PCT/US2015/028432
§ 371 (c)(1),
(2) Date: Jan. 7, 2016

(87) PCT Pub. No.: WO2016/175819
PCT Pub. Date: Nov. 3, 2016

(65) Prior Publication Data

US 2017/0101739 A1 Apr. 13, 2017

(51) Int. Cl.

| | |
|---|---|
| ***D21H 17/20*** | (2006.01) |
| ***D21H 17/24*** | (2006.01) |
| ***D21H 27/00*** | (2006.01) |
| ***D21H 27/38*** | (2006.01) |

(52) U.S. Cl.
CPC ..... *D21H 17/20* (2013.01); *D21H 17/24* (2013.01); *D21H 27/005* (2013.01); *D21H 27/38* (2013.01)

(58) Field of Classification Search
USPC ..... 162/127, 158, 175
See application file for complete search history.

(56) References Cited

U.S. PATENT DOCUMENTS

| | | | | |
|---|---|---|---|---|
| 5,672,249 | A * | 9/1997 | Vinson | D21F 11/14 162/111 |
| 5,705,216 | A | 1/1998 | Tyson | |
| 6,328,850 | B1 * | 12/2001 | Phan | B32B 29/00 162/123 |
| 6,521,240 | B1 * | 2/2003 | Minerath, III | A61K 8/02 424/400 |
| 7,419,809 | B2 | 9/2008 | Foody et al. | |
| 7,807,022 | B2 | 10/2010 | Hermans et al. | |
| 7,837,830 | B2 * | 11/2010 | Satyavolu | A21D 2/188 162/141 |
| 7,972,474 | B2 * | 7/2011 | Underhill | D21F 11/14 162/109 |
| 8,404,355 | B2 | 3/2013 | Jansen et al. | |
| 2002/0026992 | A1 | 3/2002 | Antal et al. | |
| 2005/0161179 | A1 | 7/2005 | Hermans et al. | |
| 2010/0163197 | A1 | 7/2010 | Smits et al. | |
| 2011/0256362 | A1 | 10/2011 | Mikkonen et al. | |
| 2012/0043039 | A1 | 2/2012 | Paltakari et al. | |
| 2013/0062029 | A1 | 3/2013 | Levin et al. | |
| 2013/0153828 | A1 | 6/2013 | Kaneiwa et al. | |
| 2013/0192778 | A1 | 8/2013 | Jabar, Jr. et al. | |
| 2013/0236937 | A1 | 9/2013 | Harlin et al. | |
| 2014/0166222 | A1 | 6/2014 | Delrue et al. | |

* cited by examiner

*Primary Examiner* — Dennis Cordray
(74) *Attorney, Agent, or Firm* — Kimberly-Clark Worldwide, Inc.

(57) ABSTRACT

The present invention generally relates to tissue webs and products, which generally have a basis weight less than about 80 grams per square meter (gsm) and a sheet bulk greater than about 5 cubic centimeters per gram (cc/g) comprising a blend of conventional papermaking fibers and high carbohydrate fillers. Surprisingly, the fillers may displace a relatively large amount of conventional papermaking fibers, such as hardwood kraft pulp, without negatively affecting important tissue properties such as caliper, bulk, slough, absorbent capacity and softness. In fact, in certain instances the use of fillers actually improves tissue properties.

11 Claims, No Drawings

TISSUE PRODUCTS COMPRISING HIGH CARBOHYDRATE CONTENT FILLERS

BACKGROUND OF THE DISCLOSURE

In the manufacture of paper products, inorganic fillers and pigments have been widely used for filling and coating applications. These fillers provide many benefits to the finished paper product, such as brightness, opacity, printability and dimensional stability, while also reducing manufacturing costs, energy consumption and increasing manufacturing speeds. Despite these benefits the use of inorganic fillers in tissue paper, which is often substantially lower in basis weight and higher in bulk compared to conventional paper, have been limited.

One limitation is the retention of fillers during the tissue manufacturing process, which often involves machine speeds greatly exceeding the speeds of conventional paper machines and involves exceedingly high degrees of shear. Retention of fillers in tissue products is further challenged by low basis weight of the tissue web. To compound the difficulties in retention caused by the low basis weight, tissue webs are generally low density. Those skilled in the art will recognize that such light weight, low density structures do not afford any significant opportunity to filter and retain fillers in the embryonic web. As a result, filler particles readily pass through the web and are expelled from the embryonic web as it is dewatered.

A second limitation is the general failure of particulate fillers to naturally bond to papermaking fibers in the fashion that papermaking fibers tend to bond to each other as the formed web is dried. This reduces the strength of the product. Filler inclusion causes a reduction in strength, which if left uncorrected, severely limits products which are already quite weak.

Finally, a third limitation is that tissue products containing fillers are prone to lint or dust. This is not only because the fillers themselves can be poorly trapped within the web, but also because they have the aforementioned bond inhibiting effect which causes a localized weakening of fiber anchoring into the structure. This tendency can cause operational difficulties in the creped papermaking processes and in subsequent converting operations, because of excessive dust created when the paper is handled. Another consideration is that the users of the tissue products demand that they be relatively free of lint and dust.

Consequently, there remains a need in the art for fillers for use in tissue webs and products that overcome the limitations of inorganic fillers commonly employed in the manufacture of conventional paper products.

SUMMARY OF THE DISCLOSURE

The present invention overcomes the limitations of inorganic fillers, by employing organic fillers and more specifically high carbohydrate fillers in the manufacture of tissue products. As such, the present invention generally relates to tissue webs and products, which generally have a basis weight less than about 80 grams per square meter (gsm) and a sheet bulk greater than about 5 cubic centimeters per gram (cc/g) comprising a blend of conventional papermaking fibers and high carbohydrate fillers. Surprisingly, the fillers may displace a relatively large amount of conventional papermaking fibers, such as hardwood kraft pulp, without negatively affecting important tissue properties such as caliper, bulk, slough, absorbent capacity and softness. In fact, in certain instances the use of fillers actually improves tissue properties. Also surprising is that the high carbohydrate fillers may be retained in the tissue web at relatively high rates, such as greater than about 5 percent and more preferably greater than about 10 percent, despite the filler generally having an average particle size less than about 250 μm, such as from about 25 to about 250 μm and more preferably from about 50 to about 200 μm and the tissue web being manufactured at high rates of speed and subjected to high degrees of shear. The retention of high carbohydrate fillers is generally facilitated by the use of an ionic retention aid, preferably a cationic retention aid. Additionally, use of a flocculating agent may agglomerate the high carbohydrate fillers and make it easier to retain the high carbohydrate fillers within the tissue sheet.

Accordingly, in one aspect the present invention provides a tissue product comprising at least one fibrous web comprising conventional papermaking fibers and at least about 1 percent, by weight of the web, high carbohydrate content filler, the tissue product having a GMT greater than about 600 g/3", a basis weight from about 10 to about 80 gsm and a sheet bulk greater than about 5 cc/g.

In another aspect the invention provides a tissue product comprising at least one fibrous web comprising conventional papermaking fibers and at least about 5 percent, by weight of the web, high carbohydrate content filler having an average particle size from about 50 to about 250 μm and derived from *Avena sativa, Hordeum vulgare, Triticum aestivum* or *Secale cereal* seeds, the tissue product having a GMT greater than about 600 g/3", a basis weight from about 10 to about 80 gsm and a sheet bulk greater than about 5 cc/g.

In still another aspect the invention provides a tissue product comprising at least one fibrous web consisting essentially of conventional papermaking fibers, at least about 5 percent, by weight of the web, high carbohydrate content filler having an average particle size from about 50 to about 250 μm and derived from *Avena sativa, Hordeum vulgare, Triticum aestivum* or *Secale cereal* seeds and a cationic retention aid, the tissue product having a GMT greater than about 600 g/3", a basis weight from about 10 to about 80 gsm and a sheet bulk greater than about 5 cc/g.

In yet another aspect the invention provides a durable and high bulk tissue product comprising conventional papermaking fibers and at least about 1 percent, by weight of the web, high carbohydrate content filler, the tissue product having a GMT greater than about 600 g/3", a basis weight from about 10 to about 80 gsm, a sheet bulk that is at least about 5 percent greater than a comparable tissue product substantially free of high carbohydrate filler, and a Durability Index that is at least about 5 percent greater than a comparable tissue product substantially free of high carbohydrate filler.

In another aspect the invention provides a fibrous tissue web comprising a blend of conventional papermaking fibers and from about 1 to about 20 percent, by weight of the web, high carbohydrate filler; a cationic retention aid selected from polydiallyldimethylammonium chlorides and branched polyacrylamides, the web having a basis weight less than about 60 gsm and a bulk greater than about 10 cc/g.

In still other aspects the invention provides a method of making a tissue basesheet in a wet-end stock system including a chest and a headbox comprising dispersing a high carbohydrate content filler and conventional papermaking fibers in water to form a fibrous slurry; adding a cationic retention aid to the fiber slurry between the chest and the headbox; depositing the fibrous slurry from the headbox to form a wet tissue web; and drying the wet tissue web, wherein the dry tissue web has a basis weight less than about 60 gsm and a bulk greater than about 10 cc/g.

Definitions

As used herein "average particle size" generally refers to the mean particle diameter (d50) determined by means of laser light scattering particle size analyzer such as a Microtrac S3500 particle size analyzer.

As used herein "high carbohydrate filler" (occasionally abbreviated herein as HCF) refers to a particle having an average particle size from about 25 to about 250 μm and comprising at least about 60 percent carbohydrates and more preferably at least about 65 percent carbohydrates, such as from about 60 to about 80 percent carbohydrates. Total carbohydrate content is calculated by subtraction of the sum of the crude protein, total fat, moisture, and ash from the total weight of the food. This calculation method is described in Merrill, A. L. and Watt, B. K. 1973. Energy Value of Foods . . . Basis and Derivation. Agriculture Handbook No. 74. U.S. Government Printing Office. Washington, D.C. 105p.

As used herein, the term "basis weight" generally refers to the bone dry weight per unit area of a tissue web or product and is generally expressed as grams per square meter (gsm). Basis weight is measured using TAPPI test method T-220.

As used herein, the term "Burst Index" refers to the dry burst peak load (having units of grams) at a relative geometric mean tensile strength (having units of g/3") as defined by the equation:

$$\text{Burst Index} = \frac{\text{Dry Burst Peak Load(g)}}{GMT(\text{g}/3'')} \times 10$$

While Burst Index may vary, tissue products prepared according to the present disclosure generally have a Burst Index greater than about 7.5, more preferably greater than about 8.0 and still more preferably greater than about 8.5, such as from about 7.5 to about 10.0.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "slough," also referred to herein as "pilling" and "Scott pilling," refers to the undesirable sloughing off of bits of the tissue web when rubbed and is generally measured as described in the Test Methods section below. Slough is generally reported in terms of mass, such as milligrams. While the Slough may vary, tissue products prepared according to the present disclosure generally have a Slough less than about 10.0 mg, more preferably less than about 8.0 mg and still more preferably than about 6.0 mg.

As used herein, the term "TEA Index" refers the geometric tensile energy absorption (having units of g·cm/cm$^2$) at a relative geometric mean tensile strength (having units of g/3") as defined by the equation:

$$TEA\ \text{Index} = \frac{\sqrt{MD\ TEA(\text{g}\cdot\text{cm}/\text{cm}^2) \times CD\ TEA(\text{g}\cdot\text{cm}/\text{cm}^2)}}{GMT(\text{g}/3'')} \times 1{,}000$$

While the TEA Index may vary, tissue products prepared according to the present disclosure generally have a TEA Index greater than about 10.0, more preferably greater than about 10.5 and still more preferably greater than about 11.0, such as from about 10.0 to about 12.0.

As used herein, the term "Durability Index" refers to the sum of the Tear Index, the Burst Index, and the TEA Index and is an indication of the durability of the product at a given tensile strength. Durability Index is defined by the equation:

$$\text{Durability Index} = \text{Tear Index} + \text{Burst Index} + \text{TEA Index}$$

While the Durability Index may vary, tissue products prepared according to the present disclosure generally have a Durability Index value of about 30 or greater, more preferably about 32 or greater and still more preferably about 34 or greater, such as from about 30 to about 36.

As used herein, the terms "geometric mean tensile" and "GMT" refer to the square root of the product of the machine direction tensile strength and the cross-machine direction tensile strength of the tissue product. While the GMT may vary, tissue products prepared according to the present disclosure generally have a GMT greater than about 600 g/3", more preferably greater than about 650 g/3" and still more preferably greater than about 700 g/3", such as from about 600 to about 1,200 g/3".

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "slope" refers to slope of the line resulting from plotting tensile versus stretch and is an output of the MTS TestWorks™ in the course of determining the tensile strength as described in the Test Methods section herein. Slope is reported in units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams (g).

As used herein, the term "geometric mean slope" (GM Slope) generally refers to the square root of the product of machine direction slope and cross-machine direction slope. GM Slope generally is expressed in units of kilograms (kg).

As used herein, the term "Stiffness Index" refers to GM Slope (typically having units of kg), divided by GMT (typically having units of g/3").

$$\text{Stiffness Index} = \frac{\sqrt{MD\ \text{Tensile Slope(kg)} \times CD\ \text{Tensile Slope(kg)}}}{GMT(\text{g}/3'')} \times 1{,}000$$

While the Stiffness Index may vary, tissue products prepared according to the present disclosure generally have a Stiffness Index less than about 8.0, more preferably less than about 7.5 and still more preferably less than about 7.0 such as from about 5.0 to about 8.0.

As used herein, the term "Tear Index" refers to the geometric mean tear strength (having units of grams) at a relative geometric mean tensile strength (having units of g/3") as defined by the equation:

$$\text{Tear Index} = \frac{\sqrt{MD\ \text{Tear(g)} \times CD\ \text{Tear(g)}}}{GMT(\text{g}/3'')} \times 1{,}000$$

While the Tear Index may vary, tissue products prepared according to the present disclosure generally have a Tear Index greater than about 14.0, more preferably greater than about 14.5 and still more preferably greater than about 15.0 such as from about 14.0 to about 16.0.

As used herein, the term "sheet bulk" refers to the quotient of the caliper (generally having units of μm) divided by the bone dry basis weight (generally having units of gsm). The resulting sheet bulk is expressed in cubic centimeters per gram (cc/g). Tissue products prepared according to the present invention generally have a sheet bulk greater than about 5 cc/g, more preferably greater than about 7 cc/g and still more preferably greater than about 8 cc/g, such as from about 8 to about 20 cc/g.

As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

DETAILED DESCRIPTION OF THE DISCLOSURE

Generally, tissue webs and products comprising a blend of conventional papermaking fibers and high carbohydrate filler materials are disclosed herein. The present invention overcomes several challenges often posed by the incorporation of fillers, and particularly high carbohydrate fillers, in tissue products, such as retention of the fillers at high machine speeds associated with tissue manufacture, controlling the development of tensile strength and maintaining suitable product tactile properties, such as surface smoothness and softness.

The ability to replace a significant amount of conventional papermaking fiber, and in certain embodiments conventional papermaking fibers having lower average fiber lengths, such as *eucalyptus* hardwood kraft (EHWK) pulp fibers, with high carbohydrate fillers and maintain or improve tissue product properties is surprising provided that high carbohydrate fillers have traditionally been unsuitable for use in manufacturing premium tissue products because of their poor retention, tendency to over develop strength and coarse feel. However, it has now been discovered that high carbohydrate fillers may be used in the manufacture of soft and strong tissue products through the use of ionic retention aids, and more preferably cationic retention aids, and selectively incorporating the high carbohydrate fillers in the web in modest amounts, such as less than about 20 percent.

While high carbohydrate fillers may be facially inferior to conventional papermaking fibers the present inventors have demonstrated that they may be added at levels up to about 20 percent, by weight of the tissue product, without impairing important physical properties such as durability, strength and softness. Even more surprisingly, in certain embodiments, substitution of a portion of the low fiber length fraction of the fiber furnish, such as EHWK fibers, with high carbohydrate fillers (HCF) may actually decrease stiffness (measured as Stiffness Index) while improving durability (measured as Durability Index). The improved properties of the inventive tissue products are further illustrated in Table 1 which compares a tissue product comprising 10 percent, by weight, 200 μm oat hulls and comparable tissue products consisting entirely of conventional papermaking fibers. Surprisingly substitution of a portion of the EHWK with a high carbohydrate filler (HCF) improves durability while reducing stiffness.

TABLE 1

| | Furnish Blend: 64% EHWK/ 36% NSWK | Furnish Blend: 10% HCF/54% EHWK/36% NSWK | Delta |
|---|---|---|---|
| Tear Index | 14.24 | 15.58 | 9% |
| TEA Index | 10.80 | 11.00 | 2% |
| Burst Index | 8.27 | 8.52 | 3% |
| Durability Index | 33.31 | 35.10 | 5% |
| Stiffness Index | 7.42 | 6.59 | −11% |

The high carbohydrate fillers desirably have an average particle size greater than about 50 μm, such as from about 50 to about 250 μm, and more preferably from about 50 to about 200 μm, and a carbohydrate greater than about 90 percent, such as from about 90 to about 98 percent and still more preferably from about 92 to about 98 percent.

In one embodiment the high carbohydrate fillers comprise from about 90 to about 98 percent carbohydrate and from about 70 to about 95 percent cellulose and have an average particle size from about 50 to about 200 μm. Preferably the high carbohydrate fillers have not been subjected to chemical modification, such as by the reaction with a cationizing agent. In one particularly preferred embodiment the high carbohydrate fillers naturally occur, such as plant material that has been milled to a suitable average particle size.

One source of naturally occurring, unmodified, high carbohydrate fillers are plant seeds. For example, in one embodiment, high carbohydrate fillers for use in the methods and the tissue product described herein may be derived from endospermic seeds and more preferably seeds from the Poaceae family. Particularly preferred high carbohydrate fillers are derived from cereal seeds such as oats (*Avena sativa*), barley (*Hordeum vulgare*), wheat (*Triticum aestivum*) and rye (*Secale cereale*). In certain embodiments the high carbohydrate filler may be derived primarily from the hull portion of the seed. For example, in one embodiment the high carbohydrate filler comprises milled oat hulls having an average particle size from about 50 to about 200 μm and a carbohydrate content from about 90 to about 98 percent. Methods of separating hulls from seed and milling to an appropriate average particle size are well known in the art and will not be described further here.

According, in a particularly preferred embodiment, the high carbohydrate content filler comprises from greater than about 60 percent, and more preferably greater than about 70 percent and still more preferably greater than about 75 insoluble fiber, such as cellulose, hemi-cellulose and lignin. The insoluble fiber fraction may be measured according to methods well known in the art, for example AOAC Method 991.43. For example, the high carbohydrate content filler may be derived from a cereal hull having an insoluble fiber content from about 60 to about 95 percent.

In addition to high carbohydrate fillers the tissue webs and products of the present invention also comprise conventional papermaking fibers such as wood fibers and more preferably wood pulp fibers. The wood fibers may include fibers formed by a variety of pulping processes, such as kraft pulp, sulfite pulp, thermomechanical pulp, and the like. Further, the wood fibers may be any high-average fiber length wood pulp, low-average fiber length wood pulp, or mixtures of the same. One example of suitable high-average length wood pulp fibers include softwood fibers such as, but not limited to, northern softwood, southern softwood, redwood, red cedar, hemlock, pine (e.g., southern pines), spruce (e.g., black spruce), combinations thereof, and the like. One example of suitable low-average length wood pulp fibers include hardwood fibers, such as, but not limited to, *eucalyptus*, maple, birch, aspen, and the like. In certain instances, *eucalyptus* fibers may be particularly desired to increase the softness of the web. Moreover, if desired, secondary fibers obtained from recycled materials may be used, such as fiber pulp from sources such as, for example, newsprint, reclaimed paperboard, and office waste.

The amount of high carbohydrate fillers present in the tissue product may range from about 1 to about 20 percent, by weight of the tissue product, such as from about 5 to about 20 percent, and even more preferably from about 5 to about 10 percent. The high carbohydrate filler may be blended with conventional papermaking fibers or more may be selectively disposed in one or more layers of a layered tissue web. In those embodiments where the high carbohydrate filler is selectively incorporated into one or more layers of a layered tissue web the high carbohydrate filler may comprise from about 1 to about 40 percent, by weight of the layer, and more preferably from about 5 to about 20 percent, by weight of the layer.

In a particularly preferred embodiment high carbohydrate fillers are utilized in the tissue web as a replacement for low average fiber length wood fibers such as hardwood fibers and more specifically EHWK. In one particular embodiment the high carbohydrate fillers are substituted for EHWK such that the total amount of EHWK, by weight of the tissue product, is less than about 75 percent and more preferably less than about 60 percent and the amount of high carbohydrate fillers ranges from about 5 to about 20 percent.

In other embodiments the high carbohydrate fillers may be selectively incorporated into a multi-layered tissue web and displace conventional papermaking fibers within a given layer. For example, the high carbohydrate fillers may be selectively incorporated into a three layer tissue web comprising two outer layers and center layer where the two outer layers comprise high carbohydrate fillers and hardwood kraft fibers, such as EHWK, and the center layer comprises long average fiber length fibers, such as Northern softwood kraft (NSWK).

Tissue webs useful in forming tissue products of the present invention can generally be formed by any of a variety of papermaking processes known in the art. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Examples of papermaking processes and techniques useful in forming tissue webs according to the present invention include, for example, those disclosed in U.S. Pat. Nos. 5,048,589, 5,399,412, 5,129,988 and 5,494,554 all of which are incorporated herein in a manner consistent with the present disclosure. In one embodiment the tissue web is formed by through-air drying and be either creped or uncreped. When forming multi-ply tissue products, the separate plies can be made from the same process or from different processes as desired.

The process of the present disclosure is well suited to forming multi-ply tissue products. The multi-ply tissue products can contain two plies, three plies, or a greater number of plies. In one particular embodiment, a two-ply rolled tissue product is formed according to the present disclosure in which both plies are manufactured using the same papermaking process, such as, for example, uncreped through-air dried. However, in other embodiments, the plies may be formed by two different processes. Generally, prior to being wound in a roll, the first ply and the second ply are attached together. Any suitable manner for laminating the webs together may be used. For example, the process includes a crimping device that causes the plies to mechanically attach together through fiber entanglement. In an alternative embodiment, however, an adhesive may be used in order to attach the plies together.

Additionally, webs prepared according to the present disclosure may be subjected to any suitable post processing including, but not limited to, printing, embossing, calendering, slitting, folding, combining with other fibrous structures, and the like.

When manufacturing tissue webs according to the foregoing methods it is beneficial to use a retention aid to ensure that a substantial portion of the high carbohydrate filler is retained in the web during manufacture. Various cationic retention aids are known in the art. Generally, the most common cationic retention aids are charged polyacrylamides. These retention aids agglomerate suspended high carbohydrate fillers through the use of a bridging mechanism. A wide range of molecular weights and charge densities are available. In general, high molecular weight materials with a medium charge density are preferred for flocculating the high carbohydrate fillers. The retention aid flocs are easily broken down by shear forces and are therefore usually added after the fan pump that supplies the dilute pulp suspension to the headbox of the tissue machine.

In certain embodiments the cationic retention aid may be selected from polyacrylamide, polyethylene imine, polyamines, polycyandiamide formaldehyde polymers, amphoteric polymers, diallyl dimethyl ammonium chloride polymers, diallylaminoalkyl (meth)acrylate polymers, and dialkylaminoalkyl (meth)acrylamide polymers, a copolymer of acrylamide and diallyl dimethyl ammonium chloride, a copolymer of acrylamide and diallyaminoalkyl (meth)acrylates, a copolymer of acrylamide and dialkylaminoalkyl (meth)acrylamides, a polymer of dimethylamine and epichlorohydrin, and natural and semi-synthetic polymers including cationic starch.

In still other embodiments the cationic retention aid may be selected from water-soluble copolymers of acrylamide or methacrylamide which carry or are capable of carrying a cationic charge when dissolved in water. The cationic copolymers include the following examples: copolymers of (meth)acrylamide with dimethylaminoethyl methacrylate (DMAEM), dimethylaminoethyl acrylate (DMAEA), diethylaminoethyl acrylate (DEAEA), diethylaminoethyl methacrylate (DEAEM) or their quaternary ammonium forms made with dimethyl sulfate or methyl chloride, Mannich reaction modified polyacrylamides, diallylcyclohexylamine hydrochloride (DACHA HCl), diallyldimethylammonium chloride (DADMAC), methacrylamidopropyltrimethylammonium chloride (MAPTAC) and allyl amine (ALA).

In yet other embodiments copolymers of dialkyl aminoalkyl(meth)acrylates (in cationic form) and (meth)acrylamide may be used as the cationic polymer of the present invention. Such copolymers may comprise up to about 5 mole percent anionic mer units, hence the term "cationic" as used herein includes polymers containing a minor amount of anionic units, although of course the primary nature of the polymer remains cationic.

In particularly preferred embodiments a single component retention aid system is used to manufacture the instant tissue products. In such embodiments it is generally not necessary to first add a flocculating agent such as a starch or a modified starch prior to adding the cationic retention aid. The ability to retain a sufficiently high percentage of high carbohydrate filler using a single component retention system is not only simpler and more cost effective it also ensures that the resulting tissue product does not have exceedingly high tensile strength. When manufacturing tissue products it is important to moderate the amount of tensile strength so as not to over stiffen the product and degrade softness. Using a single component retention aid, without resorting to starch flocculating agents, enables better control of tensile strength development. Without being bound by any particular theory, it is also believe that the omission of flocculating agents ensures that the high carbohydrate fillers maintain a net negative charge, which further facilitates retention using a cationic retention aid.

Thus, in certain embodiments, the present invention provides a method of manufacturing a tissue web and tissue products prepared thereby utilizing a papermaking furnish comprising a cationic retention aid, conventional papermaking fibers and a high carbohydrate content filler. In a preferred application, the amount of the cationic retention aid is 0.5 kg/ton to 10 kg/ton based on the weight of dry fibers and filler and more preferably from about 2 to about 8 kg/ton and still more preferably from about 3 to about 6 kg/ton.

In other embodiments the high carbohydrate content filler may be pretreated with the cationic retention aid before it is added to the stock. This pretreatment is a preflocculation approach and it results in certain instances may result in better dispersion of the filler throughout the stock and better filler retention. To further increase retention, pretreated filler is dosed into the stock after the last point of shear.

By manufacturing tissue webs and products according to the foregoing methods, the disclosure provides tissue webs and products having surprising characteristics. For example tissue products comprising high carbohydrate filler may have a specific absorbent capacity greater than about 10 g/g and more preferably greater than about 12 g/g, such as from about 10 to about 14 g/g.

In other embodiments the instant tissue products have sheet bulk comparable or greater than products consisting essentially of convention paper making fibers, such as a sheet bulk greater than about 8 cc/g, such as from about 8 to about 15 cc/g. In certain embodiments tissue products comprising high carbohydrate fillers may have increased sheet bulk relative to comparable tissue products substantially free of high carbohydrate fillers, such as at least about 5 percent greater sheet bulk and more preferably at least about 10 percent greater sheet bulk.

In other embodiments tissue products comprising high carbohydrate filler have improved bulk and absorbency, without a loss of durability or softness. Accordingly, in one embodiment the present invention provides a tissue product comprising at least about 5 percent, by weight, high carbohydrate filler, the product having a specific absorbent capacity about 10 percent greater than a comparable tissue substantially free of high carbohydrate filler, such as a specific absorbent capacity greater than about 12 g/g and a Stiffness Index less than about 10 and more preferably less than about 8, such as from about 5 to about 8 and a sheet bulk from about 8 to about 15 cc/g.

In still other embodiments the tissue products of the present invention may have improved durability and strength despite containing high carbohydrate fillers. For example, the tissue products may have a GMT greater than about 600 g/3", such as from about 600 to about 1,200 g/3" and a Burst Index greater than about 8.0 and more preferably greater than about 8.5. At the foregoing tensile and burst strengths the tissue products may have a Durability Index greater than about 34.0 and more preferably greater than about 35.0. Generally tissue products comprising at least about 5 percent high carbohydrate filler have a Durability Index of at least about 5 percent, and more preferably at least about 10 percent greater, than a comparable tissue product substantially free from high carbohydrate filler.

The basis weight of the basesheet used for the individual plies comprising the tissue product can vary depending upon the final product. For example, the process may be used to produce facial tissues, bath tissues, paper towels, industrial wipers, and the like. In general, the basis weight of the basesheet or individual ply of the tissue products may vary from about 5 to about 80 gsm, such as from about 10 to about 60 gsm. For bath and facial tissues, for instance, the basis weight of the individual plies comprising the tissue product may range from about 10 to about 60 gsm. For paper towels, on the other hand, the basis weight may range from about 20 to about 80 gsm.

In multiple ply products, the basis weight of each tissue web present in the product can also vary. In general, the total basis weight of a multiple ply product will generally be the same as indicated above multiplied by the number of plies, In particular, multi-ply products of the present invention may have basis weights, such as from about 20 to about 80 gsm.

Test Methods

Total Carbohydrate Content

Total carbohydrate content is calculated by subtraction of the sum of the crude protein, total fat, moisture, and ash from the total weight of the food. This calculation method is described in Merrill, A. L. and Watt, B. K. 1973. Energy Value of Foods . . . Basis and Derivation. Agriculture Handbook No. 74. U.S. Government Printing Office. Washington, D.C. 105p.

Slough

In order to determine the abrasion resistance or tendency of the fibers to be rubbed from the web when handled, each sample was measured by abrading the tissue specimens via the method as is described further in U.S. Pat. No. 6,861,380, the contents of which are incorporated herein in a manner consistent with the present disclosure. This test measures the resistance of tissue material to abrasive action when the material is subjected to a horizontally reciprocating surface abrader. All samples were conditioned at 23±0.1° C. and 50±0.2 percent relative humidity for a minimum of 4 hours. Slough values are reported in units of milligrams (mg).

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63±0.15 mm (2.5±0.006 inches) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single ply basesheet. This is done by multiplying the single ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inches (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of $g \cdot cm/cm^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a 2-ply product was tested as two plies and the tensile recorded as such. Alternatively, a single ply may be tested and the result multiplied by the number of plies in the final product to get the tensile strength.

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings has an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TAPPI conditions and cut into 127×127±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Prior to testing the height of the probe is adjusted as necessary by inserting the burst fixture into the bottom of the tensile tester and lowering the probe until it is positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is <450 gf a 10 Newton load cell is used, if peak load is >450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (go and energy to peak (g-cm) are recorded and the process repeated for all remaining specimens. A minimum of five specimens are tested per sample and the peak load average of five tests is reported as the Dry Burst Strength.

Absorption Capacity

A 4×4 inch specimen is initially weighed. The weighed specimen is then soaked in a pan of test fluid (e.g. paraffin oil or water) for three minutes. The test fluid should be at least 2 inches (5.08 cm) deep in the pan. The specimen is removed from the test fluid and allowed to drain while hanging in a "diamond" shaped position (i.e. with one corner at the lowest point). The specimen is allowed to drain for three minutes for water and for five minutes for oil. After the allotted drain time the specimen is placed in a weighing dish and then weighed. Absorbency of acids or bases, having a viscosity more similar to water, is tested in accordance with the procedure for testing absorption capacity for water. Absorption Capacity (g)=wet weight (g)−dry weight (g); and Specific Absorption Capacity (g/g)=Absorption Capacity (g)/dry weight (g).

EXAMPLES

Single ply uncreped through-air dried (UCTAD) tissue webs were made generally in accordance with U.S. Pat. No. 5,607,551. The tissue webs and resulting tissue products were formed from various fiber furnishes including, *eucalyptus* hardwood kraft (EHWK), Northern softwood kraft (NSWK) and a high carbohydrate content filler (HCF) derived from the seed of *Avena sativa* having an average particle size of about 200 μm. Fibrous webs comprising three layers were formed using a layered headbox fed by three stock chests such that the webs having three layers (two outer layers and a middle layer) were formed. The composition of each layer was varied as described in Table 2, below.

Prior to forming, each stock was further diluted to approximately 0.1 percent consistency. A solution of a cationic retention aid, Nalco Core Shell 71303 (commercially available from Nalco Company, Naperville, Ill.) was diluted with water to a concentration of 0.5 percent. The dilute cationic retention aid was added in-line at the outlet side of the fan pump of each EHWK or EHWK/HCF stream as the dilute pulp suspension traveled to the headbox at a rate sufficient to deliver from about 6 pounds of cationic retention aid per tonne of EHWK or EHWK/HCF.

The tissue web was formed on a Voith Fabrics TissueForm V forming fabric, vacuum dewatered to approximately 25 percent consistency and then subjected to rush transfer when transferred to the transfer fabric. The transfer fabric was the "Fred" fabric (commercially available from Voith Fabrics, Appleton, Wis.) previously described in U.S. Pat. No. 7,611,607, the contents of which are incorporated herein in a manner consistent with the present disclosure. The web was then transferred to a through-air drying fabric referred to as "t-1205-2" (commercially Voith Fabrics, Appleton, Wis.) and previously described in U.S. Pat. No. 8,500,955, the contents of which are incorporated herein in a manner consistent with the present disclosure. Transfer to the through-drying fabric was done using vacuum levels of greater than 10 inches of mercury at the transfer. The web was then dried to approximately 98 percent solids before winding.

TABLE 2

| Sample | NSWK (wt %) | EHWK (wt %) | HCF (wt %) | Retention Aid (lbs/tonne of furnish) |
|---|---|---|---|---|
| Control | 36 | 64 | — | 6 |
| 1 | 36 | 59 | 5 | 6 |
| 2 | 36 | 54 | 10 | 6 |

The fibrous tissue webs were converted into various bath tissue rolls. Specifically, base sheet was calendered using one or two conventional polyurethane/steel calenders comprising a 40 P&J polyurethane roll on the air side of the sheet and a standard steel roll on the fabric side. All rolled products comprised a single-ply of base sheet. The effect of HCF on various tissue strength and durability properties is summarized in tables 3 and 4 below.

TABLE 3

| Sample | Basis Weight (gsm) | Sheet Bulk (cc/g) | GMT (g/3") | Slough (mg) | GM Tear (g) | GM TEA (g*cm/cm$^2$) | Peak Burst Strength (g) |
|---|---|---|---|---|---|---|---|
| Control | 37 | 11.05 | 600 | 6.6 | 8.55 | 6.48 | 496 |
| 1 | 38 | 10.78 | 605 | 8.1 | 9.05 | 6.60 | 498 |
| 2 | 36 | 11.33 | 707 | 6.2 | 11.01 | 7.77 | 602 |

TABLE 4

| Sample | CD Stretch (%) | GM Slope (kg) | GM Tear Index | TEA Index | Burst Index | Stiffness Index | Durability Index |
|---|---|---|---|---|---|---|---|
| 1 | 10.0 | 4.45 | 14.24 | 10.80 | 8.27 | 7.42 | 33.31 |
| 2 | 10.2 | 4.37 | 14.97 | 10.91 | 8.23 | 7.23 | 34.12 |
| 3 | 10.0 | 4.66 | 15.58 | 11.00 | 8.52 | 6.59 | 35.10 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments.

In a first embodiment the present invention provides a tissue product comprising at least one fibrous web comprising conventional papermaking fibers and at least about 1 percent, by weight of the web, high carbohydrate content filler, the tissue product having a GMT greater than about 600 g/3", a basis weight from about 10 to about 80 gsm and a sheet bulk greater than about 5 cc/g.

In a second embodiment the present invention provides the tissue product of the first embodiment having a Burst Index greater than about 8.0.

In a third embodiment the present invention provides the tissue product of the first or the second embodiments having a TEA Index greater than about 10.0.

In a fourth embodiment the present invention provides the tissue product of any one of the first through the third embodiments having a Durability Index greater than about 34.

In a fifth embodiment the present invention provides the tissue product of any one of the first through the fourth embodiments having a Stiffness Index less than about 8.0.

In a sixth embodiment the present invention provides the tissue product of any one of the first through the fifth embodiments having a GMT from about 600 to about 1200 g/3" and a GM Slope from about 5 to about 8.

In a seventh embodiment the present invention provides the tissue product of any one of the first through the sixth embodiments comprising at least about 5 percent, by weight of the tissue product, high carbohydrate content fillers derived from *Avena sativa, Hordeum vulgare, Triticum aestivum* or *Secale cereal* seeds and having an average particle size from about 50 to about 250 μm.

In an eighth embodiment the present invention provides the tissue product of any one of the first through the seventh embodiments further comprising a cationic retention aid selected from polydiallyldimethylammonium chlorides and branched polyacrylamides.

In a ninth embodiment the present invention provides the tissue product of any one of the first through the eighth embodiments wherein the tissue product has a Slough less than about 10 mg.

In a tenth embodiment the present invention provides the tissue product of any one of the first through the ninth embodiments wherein the tissue product is substantially free from a flocculating agent.

In a tenth embodiment the present invention provides a tissue product comprising at least one multi-layered through-air dried tissue web comprising a first and a second layer, the second layer comprising at least about 1 percent, by weight of the layer, high carbohydrate content fillers derived from *Avena sativa, Hordeum vulgare, Triticum aestivum* or *Secale cereal* seeds and having an average particle size from about 50 to about 250 μm, the tissue product having a basis weight from about 10 to about 80 gsm, a sheet bulk greater than about 5 cc/g and a Durability Index greater than about 30.

In an eleventh embodiment the present disclosure provides a method of making a tissue basesheet in a wet-end stock system including a chest and a headbox comprising dispersing a high carbohydrate content filler and conventional papermaking fibers in water to form a fibrous slurry; adding a cationic retention aid to the fiber slurry between the chest and the headbox; depositing the fibrous slurry from the headbox to form a wet tissue web; and drying the wet tissue web, wherein the dry tissue web has a basis weight less than about 60 gsm and a bulk greater than about 5 cc/g.

In a twelfth embodiment the present disclosure provides the method of the eleventh embodiment wherein the high carbohydrate content fillers is derived from *Avena sativa, Hordeum vulgare, Triticum aestivum* or *Secale cereal* seeds and having an average particle size from about 50 to about 250 μm cationic retention aid selected from polydiallyldimethylammonium chlorides and branched polyacrylamides.

What is claimed is:

1. A durable and high bulk tissue product comprising a tissue web comprising conventional papermaking fibers and at least about 5 percent, by weight of the web, high carbohydrate content filler derived from *Avena sativa, Hordeum vulgare, Triticum aestivum* or *Secale cereal* seeds, the tissue product having a GMT greater than about 600 g/3", a basis weight from about 10 to about 80 gsm, a sheet bulk that is at least about 5 percent greater than a comparable tissue product substantially free of high carbohydrate filler, and a Durability Index that is at least about 5 percent greater than a comparable tissue product substantially free of high carbohydrate filler.

2. The tissue product of claim 1 wherein the web further comprises a cationic retention aid.

3. The tissue product of claim 1 having a Durability Index greater than about 30 and Slough less than about 10 mg.

4. The tissue product of claim 1 having a GMT from about 600 to about 1200 g/3", Stiffness Index from about 5 to about 8, a Durability Index greater than about 30 and a sheet bulk greater than about 8 cc/g.

5. The tissue product of claim 1 wherein the high carbohydrate content filler has an average particle size from about 50 to about 250 μm.

6. The tissue product of claim 1 wherein the high carbohydrate content filler has a carbohydrate content from about 90 to about 98 percent.

7. The tissue product of claim 1 wherein the web comprises from about 5 to about 20 percent, by weight of the web, high carbohydrate content filler.

8. The tissue product of claim 1 wherein the web is substantially free of a flocculating agent.

9. The tissue product of claim 1 wherein the web comprises a first and second layer and the high carbohydrate content filler is selectively incorporated in the first layer and comprises from about 5 to about 20 percent, by weight of the web.

10. The tissue product of claim 1 having a Durability Index greater than about 30 and Slough less than about 10 mg.

11. The tissue product of claim 1 wherein having a GMT from about 600 to about 1,200 g/3", Stiffness Index from about 5 to about 8, a Durability Index greater than about 30 and a sheet bulk greater than about 8 cc/g, and wherein the web comprises from about 5 to about 20 percent, by weight of the web, high carbohydrate content filler.

* * * * *